US008904675B2

(12) United States Patent
Koch et al.

(10) Patent No.: US 8,904,675 B2
(45) Date of Patent: Dec. 9, 2014

(54) FOOTWEAR ARTICLES AND FOOTWEAR ARTICLE MODIFICATION METHODS

(76) Inventors: Chanda Koch, Mt. Vernon, IL (US); Shayln Koch, Mt. Vernon, IL (US)

( * ) Notice: Subject to any disclaimer, the term of this patent is extended or adjusted under 35 U.S.C. 154(b) by 707 days.

(21) Appl. No.: 13/195,428

(22) Filed: Aug. 1, 2011

(65) Prior Publication Data

US 2013/0031803 A1 Feb. 7, 2013

(51) Int. Cl.
*A43B 3/24* (2006.01)
*A43B 3/00* (2006.01)
*A43B 1/00* (2006.01)

(52) U.S. Cl.
CPC ..... *A43B 3/0078* (2013.01); *A43D 2200/60* (2013.01); *A43B 1/0072* (2013.01); *A43B 3/242* (2013.01)
USPC ..... 36/136; 36/100

(58) Field of Classification Search
USPC ..... 36/100, 101, 136
See application file for complete search history.

(56) References Cited

U.S. PATENT DOCUMENTS

| | | | | | |
|---|---|---|---|---|---|
| 2,801,477 | A | * | 8/1957 | Adams et al. | 40/636 |
| 2,887,792 | A | * | 5/1959 | Staff | 36/100 |
| 4,516,337 | A | * | 5/1985 | Adamik | 36/136 |
| 4,536,975 | A | | 8/1985 | Harrell | |
| 4,597,198 | A | | 7/1986 | Schweitzer | |
| 4,611,416 | A | | 9/1986 | Lin | |
| 4,697,362 | A | | 10/1987 | Wasserman | |
| 4,837,960 | A | | 6/1989 | Skaja | |
| 4,852,276 | A | * | 8/1989 | Savoca et al. | 36/136 |
| 5,209,000 | A | | 5/1993 | Rowland et al. | |
| 5,282,288 | A | | 2/1994 | Henson | |
| 5,367,795 | A | * | 11/1994 | Iverson et al. | 36/136 |
| 6,115,948 | A | | 9/2000 | Mitchell | |
| 6,455,128 | B1 | | 9/2002 | Moon | |
| 6,711,836 | B2 | | 3/2004 | Weiss | |
| 6,729,058 | B2 | | 5/2004 | Ferguson | |
| 7,325,335 | B2 | | 2/2008 | Cook-Euell | |
| 7,841,107 | B2 | | 11/2010 | Braynock et al. | |
| 8,479,415 | B2 | * | 7/2013 | Berger et al. | 36/101 |
| 2006/0143951 | A1 | * | 7/2006 | Yang et al. | 36/100 |
| 2006/0207125 | A1 | | 9/2006 | Dana, III | |
| 2009/0119950 | A1 | | 5/2009 | Kohatsu et al. | |
| 2010/0000126 | A1 | * | 1/2010 | Ortner | 36/101 |
| 2010/0107441 | A1 | | 5/2010 | McKinney et al. | |
| 2010/0180469 | A1 | * | 7/2010 | Baucom et al. | 36/100 |
| 2011/0239486 | A1 | * | 10/2011 | Berger et al. | 36/136 |
| 2012/0324764 | A1 | * | 12/2012 | Velez-Cruz | 36/137 |

OTHER PUBLICATIONS

"Shoe"; http://en.wikipedia.org/wiki/Shoe; Jun. 13, 2011; 14 pps.

* cited by examiner

*Primary Examiner* — Marie Bays
(74) *Attorney, Agent, or Firm* — Wells St. John P.S.

(57) ABSTRACT

Footwear articles and footwear article modification methods are described. According to one aspect, a footwear article includes an insole configured to support a foot of an individual when the footwear article is worn by the individual, an outsole which contacts the ground when the footwear article is worn by the individual, an upper configured to hold the footwear article to the foot of the individual when the footwear article is worn by the individual, wherein the upper includes a lateral portion and a medial portion, and wherein the lateral portion of the upper is configured to retain an interchangeable placard in a position with respect to the footwear article wherein the placard covers substantially an entirety of the lateral portion of the upper of the footwear article.

15 Claims, 6 Drawing Sheets

FOOTWEAR ARTICLES AND FOOTWEAR ARTICLE MODIFICATION METHODS

TECHNICAL FIELD

This disclosure relates to footwear articles and footwear article modification methods.

BACKGROUND OF THE DISCLOSURE

Many different footwear articles have been developed of different types and for different purposes. The different types of footwear articles are applicable for different uses in athletics, occupations, fashions, etc. Oftentimes, individuals will have numerous pairs of shoes, sandals, boots, etc. depending upon activities to be performed, level of dress (formal/informal), etc. Different types and designs of footwear articles are introduced as new materials for fabricating the footwear articles are introduced and new fashion designs are introduced.

At least some aspects of the present disclosure enable wearers of footwear articles to customize and personalize their footwear differently at different moments in time. Additional aspects of the disclosure provide a database of different footwear article designs which may be accessed by individuals to customize their footwear. The disclosure also provides additional aspects as described in further detail below.

BRIEF DESCRIPTION OF THE DRAWINGS

Exemplary embodiments of the disclosure are described below with reference to the following accompanying drawings.

DETAILED DESCRIPTION OF THE DISCLOSURE

Figure 1:
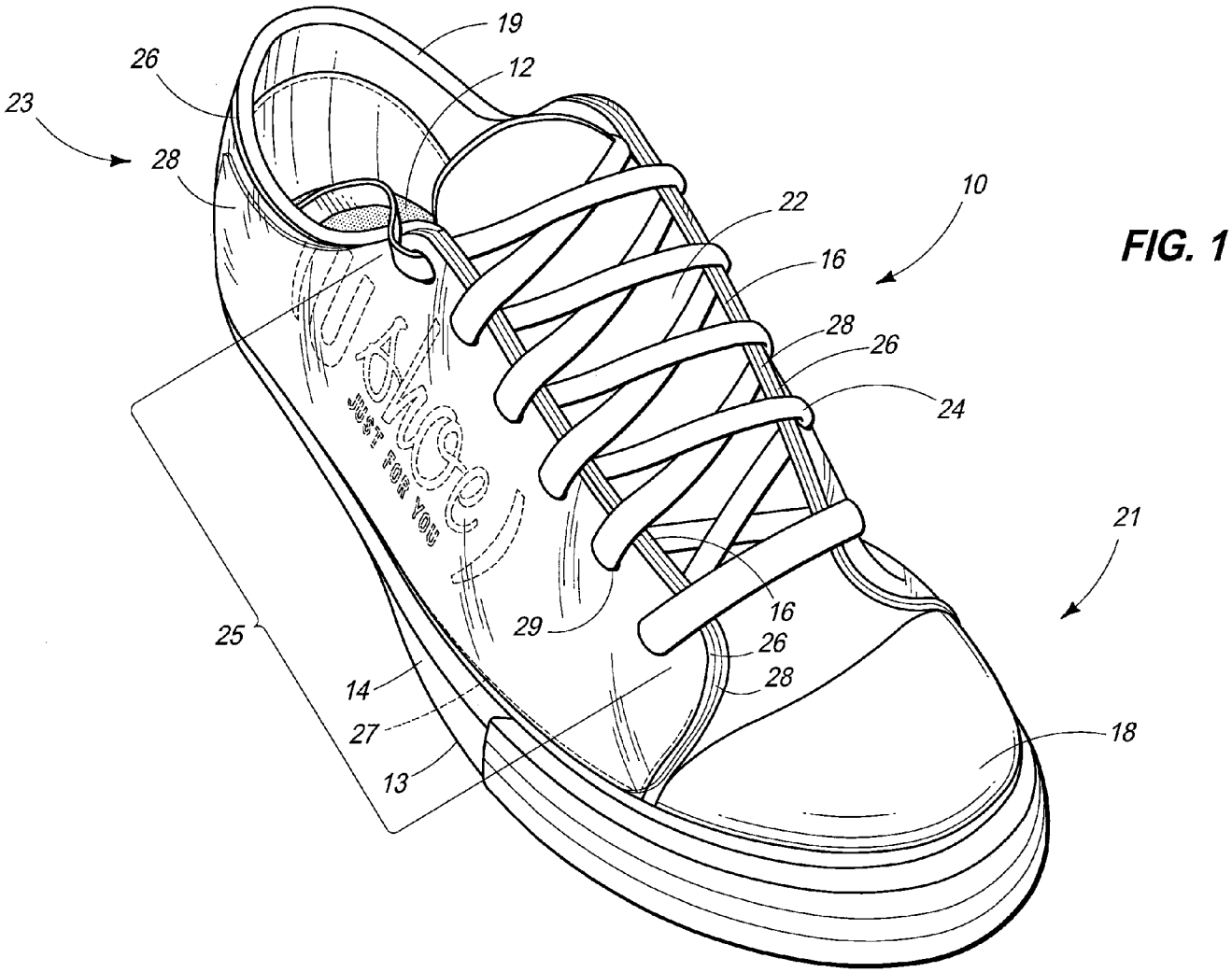
FIG. 1 is an isometric view of a footwear article according to one embodiment.

This disclosure is submitted in furtherance of the constitutional purposes of the U.S. Patent Laws "to promote the progress of science and useful arts" (Article 1, Section 8).

According to one embodiment, a footwear article comprises an insole configured to support a foot of an individual when the footwear article is worn by the individual, an outsole which contacts the ground when the footwear article is worn by the individual, an upper configured to hold the footwear article to the foot of the individual when the footwear article is worn by the individual, wherein the upper includes a lateral portion and a medial portion, and wherein the lateral portion of the upper is configured to retain an interchangeable placard in a position with respect to the footwear article wherein the placard covers substantially an entirety of the lateral portion of the upper of the footwear article.

According to an additional embodiment, a footwear article comprises an insole configured to support a foot of the individual when the footwear article is worn by the individual, an outsole which contacts the ground when the footwear article is worn by the individual, an upper configured to hold the footwear article to the foot of the individual when the footwear article is worn by the individual, wherein the upper includes a lateral portion and a medial portion, and a retaining member which is adjacent to the lateral portion of the upper and which extends from a first location of the footwear article which is adjacent to a toe region of the footwear article to a second location which is adjacent to a heel region of the footwear article, wherein the retaining member defines a pocket with the lateral portion of the upper which is configured to receive an interchangeable placard.

According to another embodiment, a placard comprises a base substrate having opposing surfaces and a shape which corresponds to a shape of one of a medial portion and a lateral portion of an upper of a footwear article, wherein the base substrate additionally includes a plurality of holes adjacent to an upper edge of the base substrate and which are configured to receive a fixing member of the article of footwear to retain the placard in a position which is adjacent to one of the medial and lateral portions of the upper of the footwear article, and wherein at least one of the opposing surfaces of the base substrate includes an image which is outwardly visible when the placard is retained adjacent to the one of the medial and lateral portions of the upper of the footwear article.

According to yet another embodiment, a footwear article modification method comprises attaching a first interchangeable placard to one of a lateral and medial portion of an upper of a footwear article, wherein the first placard covers substantially an entirety of the one of the lateral and medial portions of the upper of the footwear article when the first placard is attached to the one of the lateral and medial portions of the upper of the footwear article, wearing the footwear article upon the foot of the individual with the first placard attached to the one of the lateral and medial portions of the upper of the footwear article, removing the first placard from the footwear article, attaching a second interchangeable placard to the one of the lateral and medial portions of the upper of the footwear article, wherein the second placard covers substantially the entirety of the one of the lateral and medial portions of the upper of the footwear article when the second placard is attached to the one of the lateral and medial portions of the upper of the footwear article, and wearing the footwear article upon the foot of the individual with the second placard attached to the one of the lateral and medial portions of the upper of the footwear article.

Referring to FIG. 1, a footwear article 10 is depicted according to one embodiment. The depicted footwear article 10 is a tennis shoe for illustration and discussion purposes and the footwear article 10 may be embodied in different footwear arrangements in other embodiments, such as casual shoes, formal shoes, boots, sandals, etc.

The illustrated footwear article 10 includes an insole 12 which is configured to support a foot of an individual (not shown) when the footwear article 10 is worn by the individual. The depicted footwear article 10 also includes an outsole 13 which is configured to contact the ground when the footwear article 10 is worn by the individual.

The illustrated footwear article 10 further includes an upper 16 (also shown in FIG. 3) which is configured to hold the footwear article 10 to the foot of the individual when the footwear article 10 is worn by the individual. The upper 16 includes a medial portion (the side facing the other foot of the individual when the footwear article 10 is worn by the individual) and a lateral portion (the side facing outwardly away from the individual's other foot when the footwear article 10 is worn by the individual). The depicted footwear article 10 also includes a midsole/welt 14 between the outsole 13 and the upper 16 in the illustrated embodiment.

The footwear article 10 includes a tongue 22 which covers the top part of the individual's foot when the footwear article 10 is worn by the individual. One or more fixing members 24 may be used to retain the footwear article 10 upon a foot during use while also allowing an individual to insert and remove his foot with respect to the footwear article 10. For example, a fixing member 24 in the form of a lace may be loosened to allow a user to insert or remove their foot and may be tightened around the individual's foot when the footwear article 10 is to be worn by the individual. A single fixing member 24 in the form of a lace is used in the example embodiment of FIG. 1. Other arrangements of fixing members 24 are possible, such as one or more hook-and-loop fastening strip or other suitable arrangement.

The depicted footwear article 10 also includes a toe cap 18 adjacent to a toe region 21 of the footwear article 10 and a heel collar 19 adjacent to a heel region 23 of the footwear article 10. The regions of the lateral and medial portions of the upper 16 having the holes 29 or other receptacles for receiving the fixing member 24 may be individually referred to as an attachment region 25 which is changeable between an open configuration to permit ingress and egress of the foot of the individual into and out of the footwear article 10 and a closed configuration which holds the footwear article 10 to the foot of the individual.

Wearers of the footwear article 10 may wish to change the appearance of their footwear articles 10 from time to time. According to an aspect of the disclosure, footwear article 10 is configured to permit wears to easily change the appearance of or personalize their footwear article 10. For example, students or fans of a particular school or team may wish to change the footwear article 10 to have the name or logo of their school or favorite team. This is one illustrative example, and there may be countless other reasons for individuals to personalize their footwear articles 10 by changing the appearance of their footwear articles 10. For example, the wearers may wish to change the color of their footwear article 10 to match other clothing, provide slogans or other indicia upon their footwear articles 10, or for other reasons. Various illustrative embodiments are disclosed which permit individuals to easily personalize or otherwise change the appearance of their footwear articles 10.

Still referring to the example embodiment of FIG. 1, the upper 16 is configured to retain one or more interchangeable placard 28 adjacent to one or both of the lateral and medial portions of the upper 16 which changes the appearance of one or both of the lateral and medial portions of the upper 16. A user may design or purchase a plurality of different placards 28 having different images to personalize or change the appearance of their footwear differently at different moments in time in one embodiment.

In one embodiment, retaining members 26 may be provided adjacent to the lateral and medial portions of the upper 16 to retain the placards 28 adjacent to the lateral and medial portions of the upper 16 during wear of the footwear article 10. Additional details regarding this example embodiment of retaining members 26 which are configured to retain the placards 28 adjacent to the lateral and/or medial portions of the upper 16 are discussed below with respect to FIG. 3.

The placement of the placard 28 adjacent to one of the lateral and medial portions of the upper 16 personalizes or changes the appearance of the respective one of the lateral and medial portions of the upper 16 as the placard 28 is configured to cover substantially an entirety of the respective one of the lateral and medial portions of the upper 16 above the midsole 14 in the illustrated embodiment. Users may also wish to use plural placards 28 to simultaneously cover the lateral and medial portions of the upper 16 to further the modification of the appearance of their footwear article 10.

Figure 2:
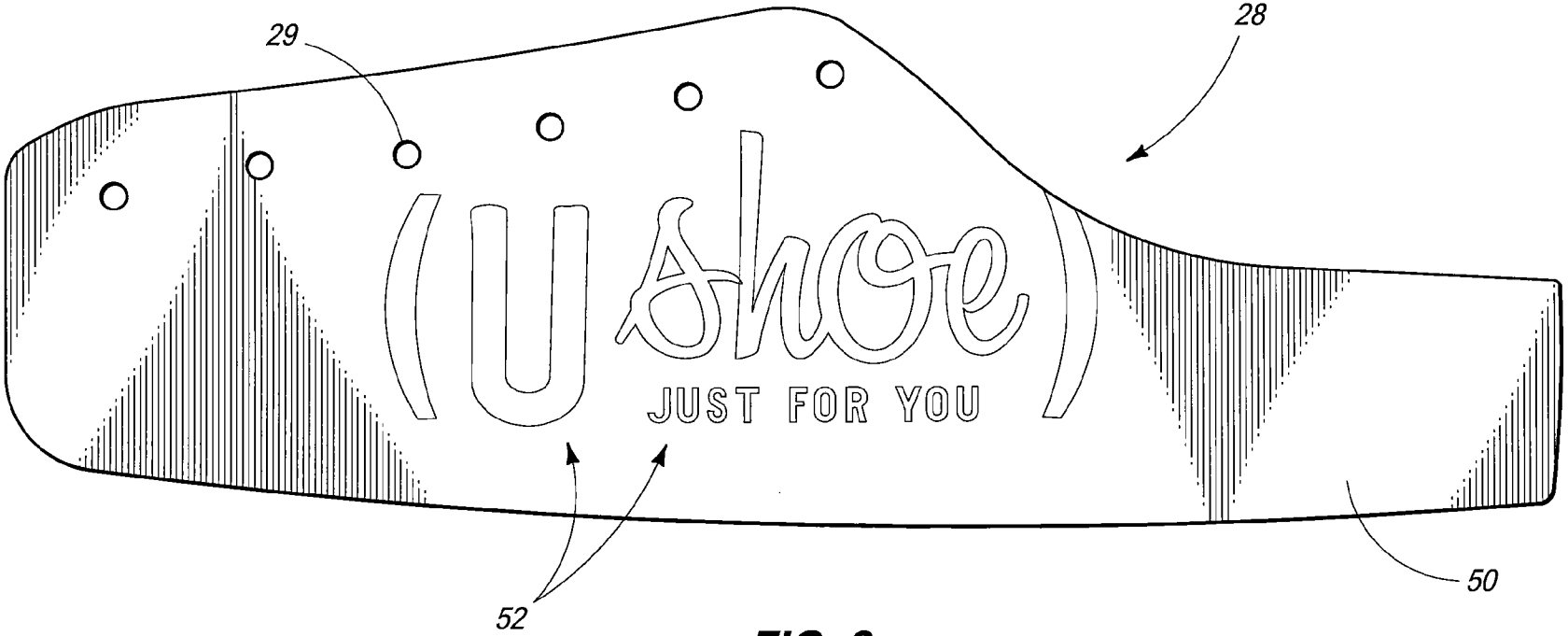
FIG. 2 is a front view of an interchangeable placard according to one embodiment.

Referring to FIG. 2, an example of a placard 28 is shown according to one embodiment. The placard 28 includes a base substrate 50 which has opposing surfaces for images 52 in the illustrated embodiment (only one of the opposing surfaces is shown in FIG. 2). The base substrate 50 also has a shape which corresponds to a shape of one of a medial portion and a lateral portion of upper 16 of footwear article 10 in the illustrated embodiment. The base substrate 50 may be flexible material or semi-rigid material, and may vary in thickness. In one specific embodiment, the base substrate 50 is 3 mil styrene sheet material.

The base substrate 50 and/or images 52 may be provided in different colors desired by the individual. Images 52 upon the placards 28 may include text, indicia, graphical designs, logos, photographs, slogans, names, and/or team names in some examples. Furthermore, an image 52 upon the placard 28 may include an augmented reality symbol which when scanned or interpreted by an electronic device (e.g., Smartphone—not shown) may cause an augmented reality image or additional graphical, audio or video content to be generated by the electronic device. In one embodiment, the images 52 may be printed upon the base substrate 50, or upon another material, such as print quality calendared vinyl in one example, which may be adhered to the substrate 50.

The illustrated embodiment of the placard 28 in FIG. 2 also includes holes 29 which are configured to receive fixing member 24 of the footwear article 10. In one embodiment, the placards 28 are reversible with an image 52 upon one surface of the placard 28 being visible when used adjacent one of the lateral and medial portions of the upper 16 and an image 52 upon the other surface of the placard 28 being visible when used adjacent the other of the lateral and medial portions of the upper 16.

Figure 3:
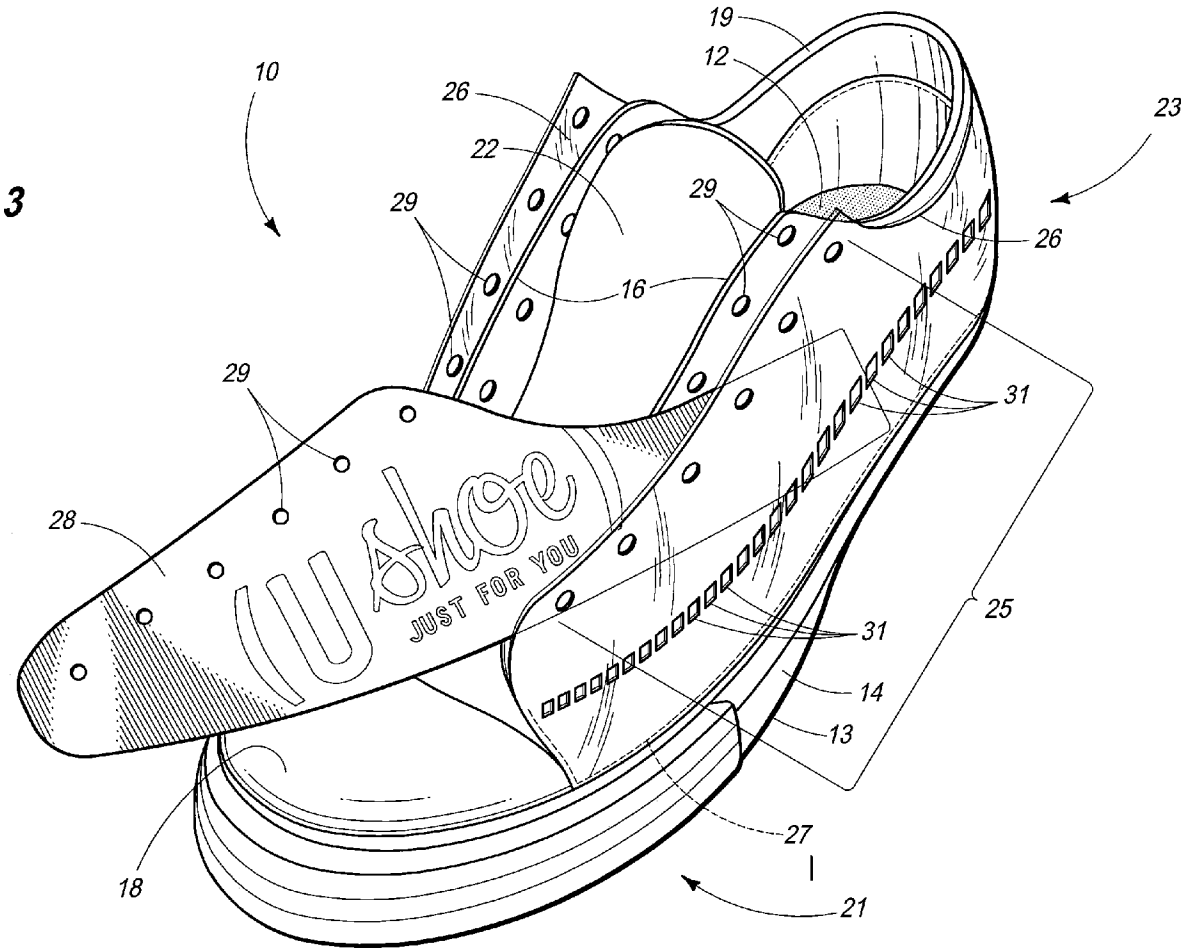
FIG. 3 is an isometric view of a footwear article during changing of an interchangeable placard according to one embodiment.

As mentioned above, placards 28 may be used to personalize or change the appearance of the footwear article 10. Referring to FIG. 3, the fixing member 24 in the form of laces in FIG. 1 has been removed from the footwear article 10. FIG. 3 illustrates the changing of placard 28 with respect to footwear article 10 according to one possible arrangement. An individual may wish to change the placards 28 (and text and/or designs thereon) of the footwear article 10 from time-to-time.

In the illustrated embodiment, the retaining members 26 of footwear article 10 are positioned adjacent to and cover substantially the entirety of the lateral and medial portions of the upper 16. In the depicted embodiment, the retaining members 26 have generally the same shape as the lateral and medial portions of the upper 16. In some embodiments, a retaining member 26 may be provided adjacent to only one of the lateral and medial portions of the upper 16.

Figure 5:
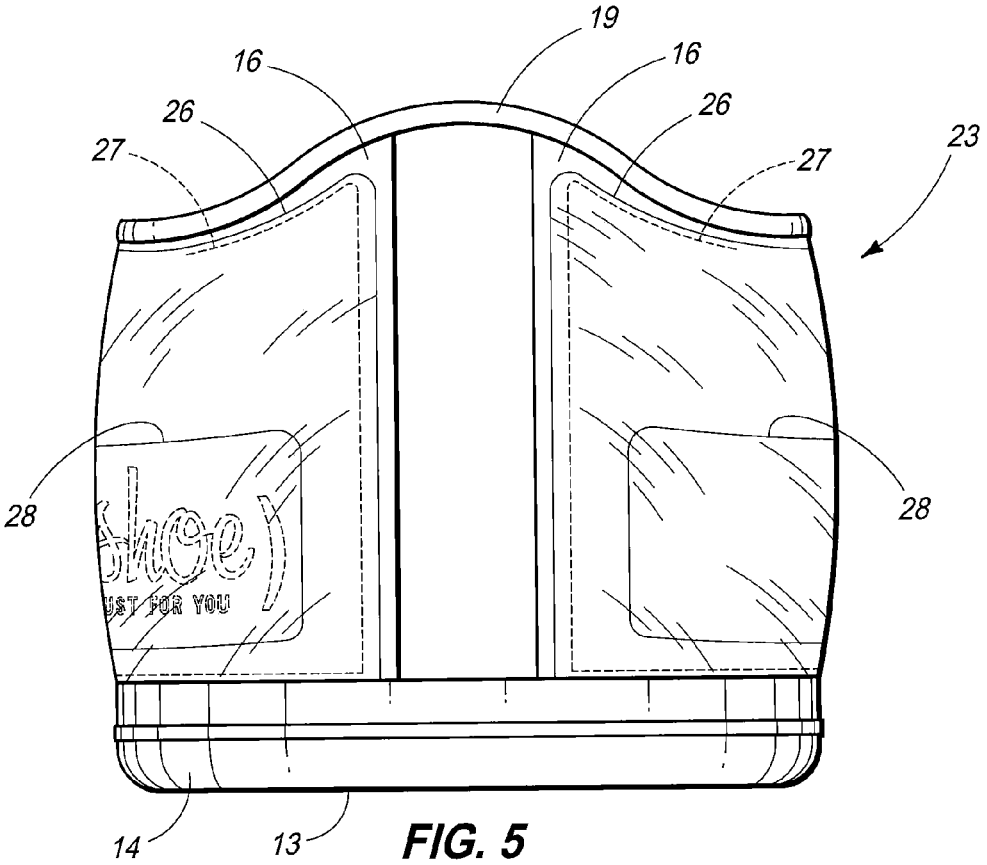
FIG. 5 is a side view of a heel region of a footwear article according to one embodiment.

The retaining members 26 may be attached to the lateral and medial portions using stitching 27 along the lower edge of the retaining members 26 and through corresponding locations of the lateral and medial portions of the upper 16. The stitching 27 may also extended upward adjacent to the toe cap 18 and may also extend upward and forwardly in the heel region 23 as shown in FIG. 5. The upper edges of the retaining members 26 are not attached to the upper 16 by stitching 27 but rather are left unattached in one embodiment to form openings to lateral and medial pockets which are formed by the respective lateral and medial retaining members 26 and the respective lateral and medial portions of the upper 16.

In the depicted arrangement, the upward facing openings to the lateral and medial pockets extend approximately ¾ to ⅞ the distance from the toe cap 18 to a most rearward portion of the heel of the footwear article 10. As shown in the example embodiment of FIG. 3, once the fixing member 24 is removed, the placard 28 may be inserted into or removed from the lateral or medial pocket.

Other methods than stitching for attaching the retaining members 26 to the upper 16 may be used, such as using an appropriate adhesive or glue. The shape of the lateral and medial pockets generally correspond to the shape of the placards 28 (and the lateral and medial portions of the upper 16) and the placards 28 may be slightly smaller in scale than the lateral and medial pockets to facilitate insertion and removal of the placards 28 with respect to the lateral and medial pockets.

In one embodiment, the retaining members 26 permit the placards 28 to be outwardly visible when the placards 28 are attached to the lateral and medial portions of the upper 16. For example, in one embodiment, the retaining members 26 are substantially transparent, permitting the images 52 of the placards 28 to be visible through the retaining members 26. In one more specific implementation, the retaining members 26 may be 20-80 gauge clear vinyl. Furthermore, in some embodiments, the retaining members 26 may include a plurality of perforations 31 to provide improved "breathability" to assist with cooling of the individual's foot as well as evaporation of sweat. More or less perforations 31 and perforations 31 of different sizes and configurations may be provided in other embodiments and may be provided throughout substantially the entirety of the retaining members 26 in one more specific example. In yet another embodiment, the retaining members 26 may be made of a clear mesh, such as clear plastic mesh. Other configurations of retaining members 26 may also be utilized.

In the illustrated embodiment, the placards 28, the lateral and medial portions of the upper 16, and the retaining members 26 individually include a top edge and a plurality of holes 29 adjacent to the respective top edge. The holes 29 of the lateral and medial placards 28, the lateral and medial retaining members 26, and lateral and medial portions of the upper 16 may be aligned with one another and configured to receive one or more suitable fixing member 24 (e.g., laces, hook and loop fasteners, etc.) when the lateral and medial placards 28 are received within the respective lateral and medial pockets. The passage of the fixing member 24 through the placard 28 as well as the lateral and medial portions of the upper 16 operates to secure and maintain the placards 28 in appropriate locations to cover the lateral or medial portions of the upper 16 and also prevent the placards 28 from falling out of the lateral and medial pockets. Furthermore, passage of the fixing member through the retaining members 26 also closes the lateral and medial pockets and assists with maintaining the placards 28 within the lateral and medial pockets. In some embodiments, the fixing member 24 may not be passed through one or both of the placards 28 or retaining members 26.

Other embodiments of retaining members 26 are possible to retain the placards 28 in positions adjacent to the lateral and/or medial portions of the upper 16. Additionally, other arrangements may be used to attach the placards to the lateral and medial portions of the upper 16 in different embodiments of footwear article 10. For example, the placards 28 may be adhered to the lateral and medial portions of the upper 16 using an appropriate adhesive in but one other example. In such an embodiment, the adhesive may permit the placards 28 to be removed and different placards 28 may be attached to the footwear article 10.

Figure 4:
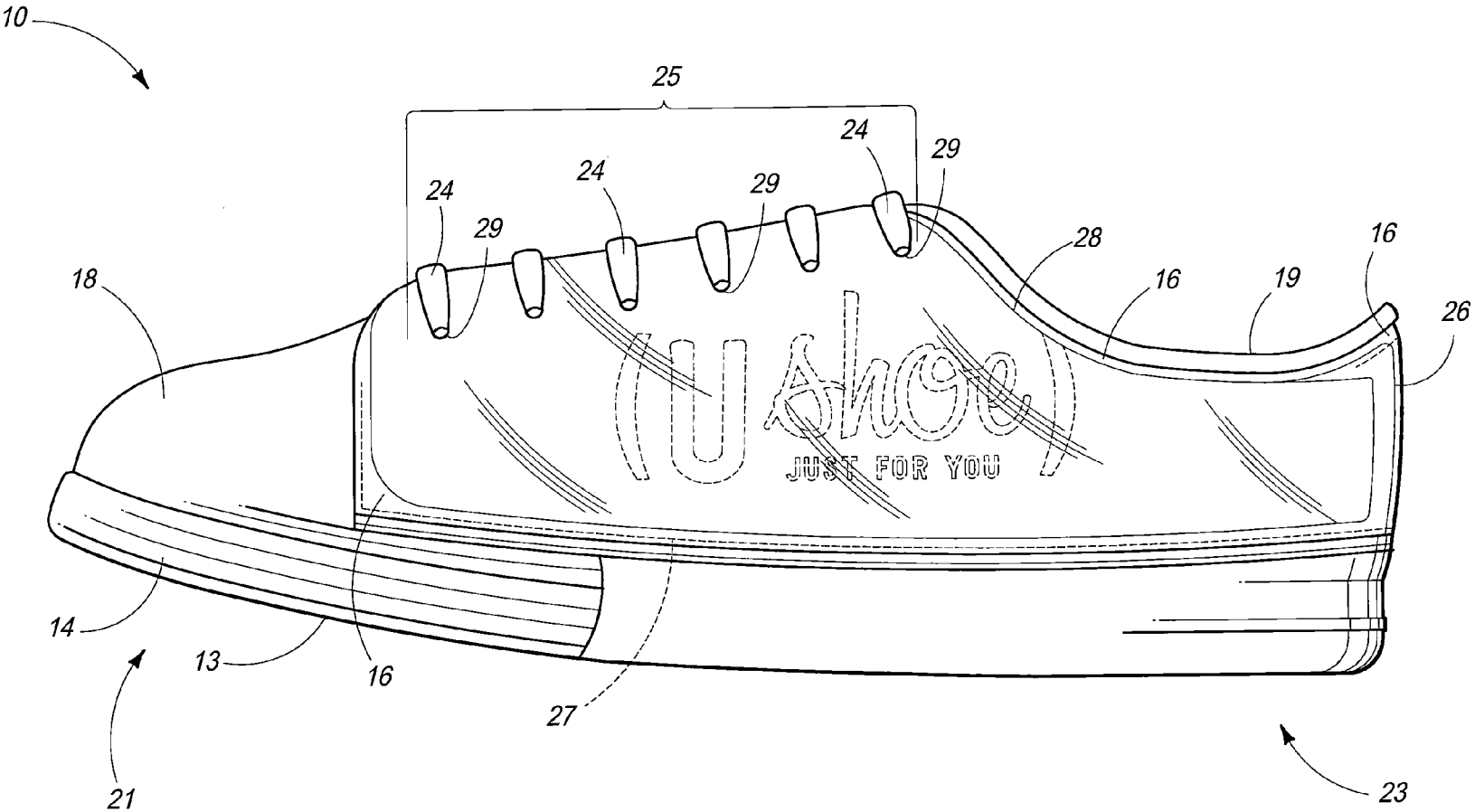
FIG. 4 is a front view of a footwear article according to one embodiment.

As shown in FIG. 4, the use of the lateral and medial placards 28 substantially covers or masks the lateral and medial portions of the upper 16 and changes the substantially the entire outward appearance of the footwear article 10. In one embodiment, the retaining members 26 and placards 28 extend past the attachment region 25 in a forward direction adjacent to the toe region 21 of the footwear article 10 and past the attachment region 25 in a rearward direction adjacent to the heel region 23 of the footwear article 10. In the example embodiment of FIG. 4, the placards 28 may extend from a first location of the footwear article 10 which is adjacent to toe region 21 to a second location which is adjacent to heel region 23.

Figure 5A:
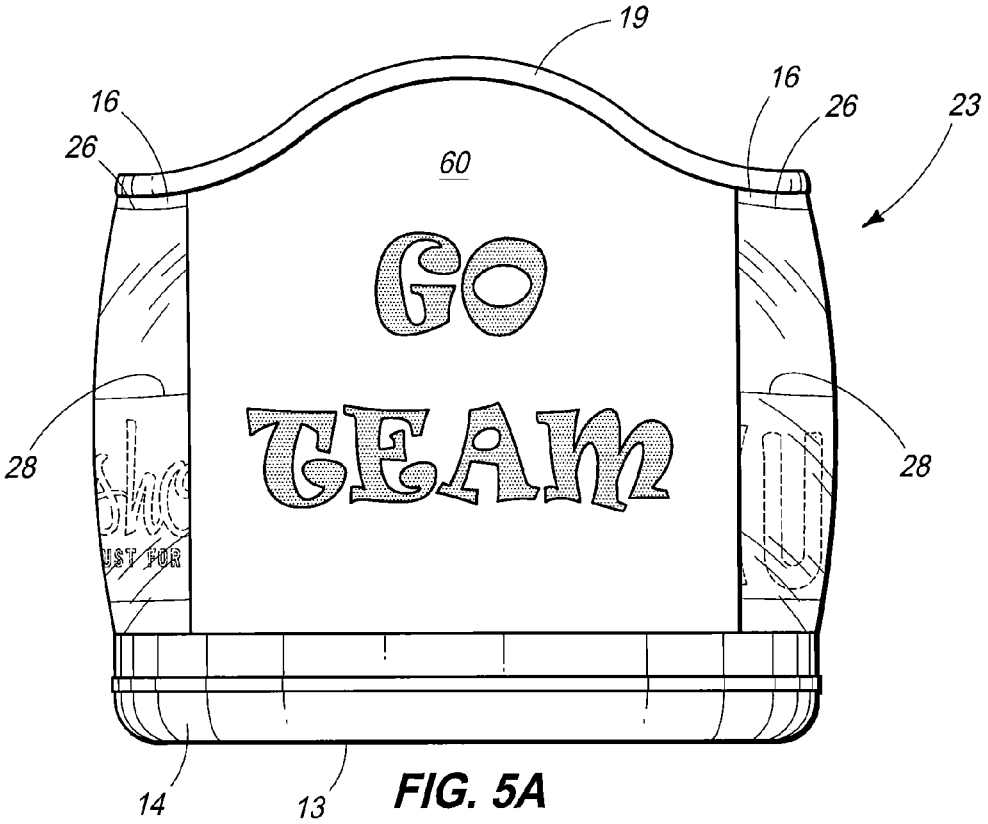
FIG. 5A is a side view of a heel region of the footwear article with a heel cover according to one embodiment.

Referring to FIGS. 5 and 5A, a heel region 23 of the footwear article 10 is shown according to one embodiment. Stitching 27 operates to affix the retaining members 26 to the lateral and medial portions of the upper 16. In one embodiment, the stitching 27 extends forward along both the lateral and medial portions of the upper 16 towards the toe region to locations which are below the heel collar 19 as shown in illustrated embodiment of FIG. 5 and which define lateral and medial heel pockets which open toward the toe region 21 to receive the portions of the placards 28 which are adjacent to the toe region 23.

Referring to FIG. 5A, a heel cover 60 may be applied at the heel region 23 of the footwear article 10 in one embodiment. The heel cover 60 may be attached to an appropriate portion of the footwear article 10 (e.g., retaining members 26 if present) in any suitable fashion, such as using an appropriate adhesive, in one implementation. In addition, the heel cover 60 may have desired colors and/or images which correspond to the colors and/or images 52 upon the placards 28 if desired. In one embodiment, the adhesive may permit the heel cover 60 to be removed and a different heel cover may be attached to the footwear article 10. The use of the heel cover operates to mask or cover additional outward portions of the footwear article 10 which may not be covered by the placards 28.

In one more specific example, the heel cover 60 may be constructed of either a replaceable self-adhesive printed vinyl material which may be adhered to the footwear article 10 or another material which may be sewn or otherwise adhered to the footwear article 10. In one example sewn embodiment, the stitching may be provided through the heel cover 60 and retaining members 26 but not the lateral and medial portions of the upper 16 to permit the placards 28 to be received with the portions of the lateral and medial pockets which are adjacent to the heel region 23. The heel cover 60 may have different shapes or designs in different embodiments and for use with different types of footwear articles 10. In one embodiment, the heel cover 60 extends downward from the heel collar 19 to the midsole 14, as well as extending forwardly towards the toe region 21 to mask or cover portions of the footwear article which may not be covered by the placards 28.

As described above, some embodiments of the disclosure are directed towards footwear articles 10 and placards 28 to be used with the footwear articles 10. Additional aspects of the disclosure are described below with respect to management of images 52 for the placards and making the images 52 available for browsing and ordering by owners of the footwear articles 10 and others.

Figure 6:
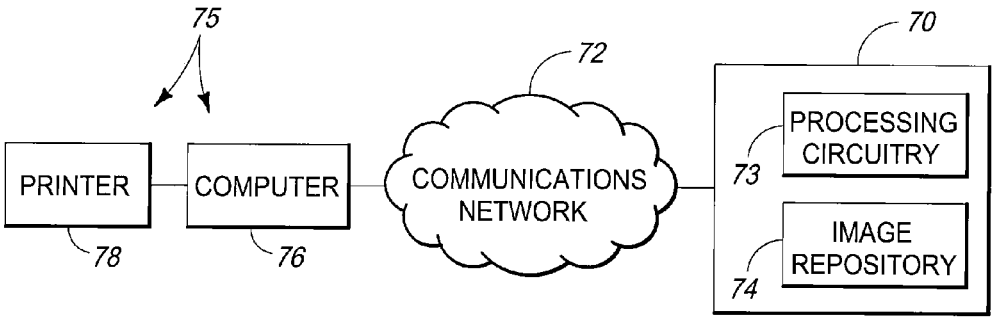
FIG. 6 is a block diagram of a system for managing sales of footwear articles and images of interchangeable placards according to one embodiment.

Referring to FIG. 6, one example embodiment of a system is shown which is configured to receive and manage images which may be used upon the placards and to make the images available to the public for use on placards.

In the illustrated embodiment, a server 70 which may be associated with an entity which manages and offers images for use with placards is shown. The server 70 includes processing circuitry 73 and an image repository 74 in one embodiment. Server 70 may also include additional components and/or circuitry which are not shown, such as communications circuitry for communicating with communications network 72, a user interface, etc. In one embodiment, server 70 is associated with a web site which may be accessed by other parties, for example, via communications network 72.

In one embodiment, processing circuitry 73 is arranged to process data, control data access and storage, issue commands, and control other desired operations. Processing circuitry 73 may comprise circuitry configured to implement desired programming provided by appropriate computer-readable storage media in at least one embodiment. For example, the processing circuitry 73 may be implemented as one or more processor(s) and/or other structure configured to execute executable instructions including, for example, software and/or firmware instructions. Other exemplary embodiments of processing circuitry 73 include hardware logic, PGA, FPGA, ASIC, state machines, and/or other structures alone or in combination with one or more processor(s). These examples of processing circuitry 73 are for illustration and other configurations are possible.

Although not shown, the server 70 may also include storage circuitry which is configured to store the image repository 74, programming such as executable code or instructions (e.g., software and/or firmware), electronic data, databases, image data, or other digital information and may include computer-readable storage media. At least some embodiments or aspects described herein may be implemented using programming stored within one or more computer-readable storage medium of storage circuitry and configured to control appropriate processing circuitry 73.

The computer-readable storage medium may be embodied in one or more articles of manufacture which can contain, store, or maintain programming, data and/or digital information for use by or in connection with an instruction execution system including processing circuitry 73 in the exemplary embodiment. For example, exemplary computer-readable storage media may include any one of physical media such as electronic, magnetic, optical, electromagnetic, infrared or semiconductor media. Some more specific examples of computer-readable storage media include, but are not limited to, a portable magnetic computer diskette, such as a floppy diskette, a zip disk, a hard drive, random access memory, read only memory, flash memory, cache memory, and/or other configurations capable of storing programming, data, or other digital information.

In one embodiment, the image repository 74 includes a plurality of images which may be downloaded by individuals and printed upon their placards for their footwear articles. Furthermore, as discussed in additional detail below, people may also upload images into the image repository which may be offered for use by others, and the submitters of the images may be compensated for the use of their images.

Communications network 72 is any appropriate configuration or arrangement for implementing communications between different computers or computing devices and may include the Internet in at least one embodiment.

For example, a user location 75 (business, house, apartment, dormitory, etc.) may include a computer 76 and a printer 78. Computer 76 may be utilized to access the server 70 and may download or upload images with respect to server 70 according to one embodiment. Furthermore, downloaded images may be printed by customers upon placards for use with the footwear articles using printer 78 in one embodiment.

Figure 7:
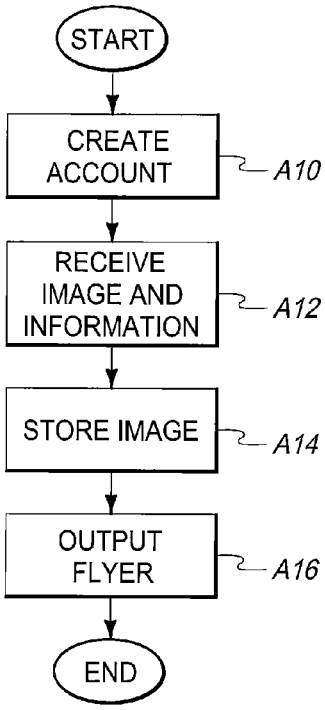
FIG. 7 is a flow chart of a method of receiving a new placard design according to one embodiment.

As mentioned above, people may upload images to server 70 and the images may be offered for use, and perhaps sale, to others accessing server 70. Enabling others to contribute to the repository of images increases the size and diversity of images which may appeal to an increased number of possible customers. Referring to FIG. 7, one possible method for managing received images is shown and which may be implemented by processing circuitry 73 in one embodiment. Other methods including more, less and/or alternative acts are possible.

People or organizations who wish to promote their images (e.g., designs, trademarks, images, slogans, etc.) by uploading images to the image repository 74 may be referred to as graphical contributors. The method of FIG. 7 describes a method which enables the graphical contributors to establish an account and upload images which may be offered to others via server 70.

At an act A10, a graphical contributor creates an account with an entity who operates or is otherwise associated with the server 70. At act A10, the graphical contributor may be required to enter into an agreement with the operator of the server 70 and provide requested information. For example, graphical contributors may be requested to provide information regarding their name, contact information (e.g., address, city, state, telephone number, email address, etc.), entity type (e.g., individual, sole proprietorship, partnership, corporation, limited liability company, etc.), contact person, Employer ID number (FEIN), Social Security number, a user name (e.g., email address), a password to access their account, Pay Pal or other payment account information, and any other requested information.

As mentioned above, the graphical contributors may be required to enter an agreement with the operator of the server 70 or other appropriate entity in one embodiment. The agreement may specify that the contributor will own their images but will grant the operator of the server a right/license to market and sell the images to customers via their website and/or other commercial mechanism. Further, an example agreement may require the graphic contributor to represent and warrant that it owns the copyrights for uploaded images, the graphic contributor will provide the operator of the server with a license to market, manufacture and distribute the images in association with the placards, the graphic contributor shall hold harmless and indemnify the operator of the server from any claims regarding copyright infringement or violation of other laws, rules or regulations by the graphic contributor, the graphic contributor agrees to set the licensing fee for all images uploaded to the web site, the graphic contributor agrees to pay the operator of the server a marketing and promotion fee (e.g., e.g., 25-50% of the sales price of an image in one example) with respect to sales of the images for the placards, and the graphic contributor agrees that the operator of the server has the authority to set the price for selling the images by the graphic contributor, the graphic contributor understands that the operator of the server may suspend or terminate the graphical contributor's account and may also prohibit the display of certain images. In one example, the agreement executed by the graphic contributor may specify that a set price shall be earned each time the image is printed on a set of two placards, each time the image is downloaded, or based upon other agreed terms.

In exchange for agreeing to the specified terms, the graphic contributors have ability via the server 70 and/or other arrangements associated with the operator of the server 70 to offer and promote their own images in conjunction with the offered footwear articles and placards, and also receive compensation for purchases of their images. Their images may be sold with purchases of footwear articles (for use upon the placards for the footwear articles) or for use with the placards themselves without the purchase of the footwear articles. Furthermore, the operator of the server benefits from the ability to make an increased number of diverse images available for use by customers from different graphical contributors.

At an act A12, the graphic contributor may log-in to their account in order to upload an image. Furthermore, once logged-in, the graphic contributor may in addition to uploading images, edit their user profile, review a transaction history, edit prices of their images, and remove images.

Accordingly, the server may receive an image and associated information for the image from the graphic contributor. In one embodiment, the graphic contributor, for each uploaded image, may be required to certify that the previously-executed agreement applies to the uploaded image, specify the price for the image, provide a title and description for the image, categorize the image according to a list of general categories, tag the image as being available for public distribution or private use only (e.g., if private, then the graphic contributor may specify who can view and purchase the image), designate whether the graphic contributor wishes to remain anonymous, and designate whether they wish to receive an marketing flyer from the operator of the server 70 in order to promote a footwear article design based upon the image.

At an act A14, the image may be stored and appropriately categorized in the image repository 74 as well as being made available for viewing and downloading by customers.

At an act A16, the server may, if appropriate, communicate a flyer to the graphical contributor for their use to promote their image(s) and which highlights the image(s), footwear article, the graphic contributor, description, price and any other desired information.

Figure 8:
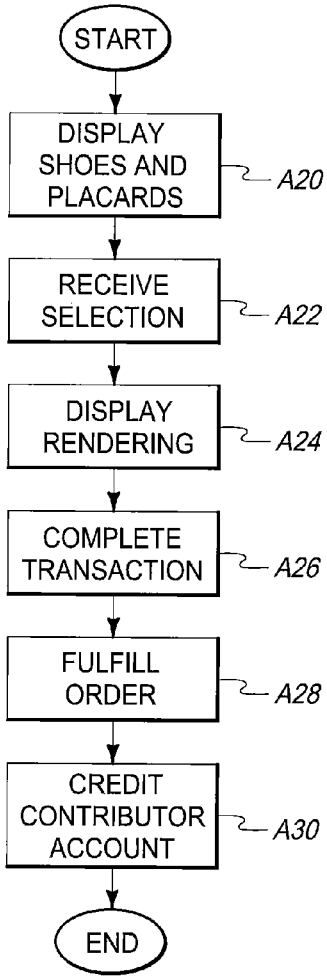
FIG. 8 is a flow chart of a method of implementing a transaction with respect to the sale of a footwear article and/or image for placards according to one embodiment.

Referring to FIG. 8, one possible method for ordering footwear articles and/or images for a placard from server 70 is shown according to one embodiment. The method may be implemented by processing circuitry 73 in one embodiment. Other methods including more, less and/or alternative acts are possible.

At an act A20, the server operates to serve webpages in one embodiment which include footwear articles for sale, placards for sale, and images which are available to be purchased and/or downloaded. For example, the server may present webpages including a search page, catalog, and/or categories of different footwear articles, placards, images and associated items which are available. The server may receive search queries (e.g., key words or phrases for images of certain teams, groups, themes, or uploaded by certain graphic contributors) and respond with matching results.

At an act A22, a customer may enter their desired selection for the footwear articles, placards, images, and/or other items and associated information (e.g., foot size, footwear article type or style, etc.).

At an act A24, the server may generate a rendering of the customer's selection which may be viewed by the customer, for example, as a three-dimensional image of the appropriate footwear article with an appropriate placard having a selected image.

At an act A26, if the customer is satisfied, they may complete the transaction to purchase the selected items or images. In one embodiment, the server may provide e-commerce shopping cart functionality to allow customers to review their order and complete the transaction. In one embodiment, customers may be required to accept terms of a customer agreement and provide requested information, such as name, address information, gender, email address, phone number, payment method (e.g., credit card, pay pal, etc.), user name, and password.

At an act A28, the server may initiate fulfillment of the customer's order. In one embodiment, the server may output an email to the customer which operates as a receipt for the order and thanks and confirms their order, provide details regarding the order (e.g., customer information, order date, sales order identification information, item identification, quantity of items ordered, style information of items ordered, name of the graphic contributor, price per item, shipping address, etc.).

In one arrangement, the operator of the server 70 may employ order fulfillment personnel for processing. Data regarding the order may be provided to the order fulfillment, including a copy of the order/invoice, a picking order and/or shipping order for footwear articles which are part of the order, a work order for printing of images for the placards included in the order, a print ready and formatted electronic file of the images included in the order, and/or a shipping label and instructions for shipping of the footwear articles, placards and other items to the customer.

Orders for footwear articles may be picked from inventory in one embodiment. Placards may be printed with appropriate images and the placards may be cut by a router to appropriate sizes of the appropriate type of footwear article in one embodiment. Shipping labels are printed including information provided by the customer. Information regarding the order may be stored in the server and an email may be sent by the server to the customer indicating the date, time and content of a shipment of the order. The server may also provide a customer account section which permits customers to track the status of pending orders and to review historical transactions.

At an act A30, the accounts of the appropriate graphic contributors whose images were purchased may be credited as a result of a customer placing the order. The amount of the credit may be based upon the price per image specified by the graphic contributor minus any respective fees charged by the operator of the server. The credits may be placed in a pending status until a refund period for the order expires (e.g., 30 days). Upon expiration of the refund period, the operator of the server may initiate a payment to the payment account of the graphic contributor.

Furthermore, server 70 may also record and archive all transaction information regarding purchases affiliated with a graphic contributor's account. The graphic contributors may access and review their full transactional history via their user account. Additionally, server 70 may generate and email each graphic contributor a history of transactions for their images for the past year as well as an IRS Form 1099, if applicable. Server 70 may also store all correspondence between customers and graphic contributors may also be stored and archived in one embodiment.

Accordingly, in one embodiment, owners of the footwear may navigate to an appropriate web page and search and order different graphical images which may be printed upon placards and shipped to the purchasers, or alternatively, the graphical images may be communicated to the owners who may then print the images upon a placard substrate using an ink jet or other suitable printer.

In one more specific example, sheets of placard substrate material may be made available for printing of the placards. A sheet of placard substrate material may be standard sized (e.g., 8.5"×11") and may include outlines of a plurality of placards which may be printed upon in one example. In one embodiment, the outlines of the placards may be embossed or perforated (e.g., die stamped) for easy removal of the placards from the sheet after printing. In another aspect, different sheets of placard substrate material may be made available for sale with different sizes of placard outlines thereon for use with different sizes of footwear.

The above-described example methods of receiving images and selling footwear articles, placards, images and other items via a website is one possible method and the footwear articles, placards, images and other items may also be sold in other appropriate ways in other embodiments. For example, a shoe store may sell the footwear articles, placards and related items and perhaps have an in-store catalog of images or access to server to search a database of the available images and print the images upon appropriate placards.

As described herein, different aspects of the disclosure enable customers to easily personalize and modify the outward appearance of their footwear which promotes individual expression and creativity and fosters relationships and bonds through involvement with others as part of groups, clubs, teams, and families. Different aspects of the disclosure foster and reward creativity by enabling designers of images to provide their own unique designs for use by others, and perhaps be compensated for the use.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

Further, aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe methods which include less, more and/or alternative steps than those methods explicitly disclosed as well as apparatus which includes less, more and/or alternative structure than the explicitly disclosed structure.

What is claimed is:

1. A footwear article comprising:

an insole configured to support a foot of an individual when the footwear article is worn by the individual;

an outsole which contacts the ground when the footwear article is worn by the individual;

an upper configured to hold the footwear article to the foot of the individual when the footwear article is worn by the individual, wherein the upper includes a lateral portion and a medial portion;

wherein the lateral portion of the upper is configured to retain an interchangeable placard in a position with respect to the footwear article wherein the placard covers substantially an entirety of the lateral portion of the upper of the footwear article; and wherein the lateral and medial portions of the upper individually comprise a retaining region which is changeable between an open configuration to permit ingress and egress of the foot of the individual into and out of the footwear article and a closed configuration wherein the upper holds the footwear article to the foot of the individual, and wherein the placard extends past the attachment region in a forward direction toward a toe region of the footwear article and a rearward direction toward a heel region of the footwear article.

2. The article of claim 1 further comprising a substantially transparent retaining member which defines a pocket with the lateral portion of the upper, and the pocket is configured to receive the placard.

3. The article of claim 2 wherein the retaining member and the placard individually extend from a heel region to a toe region of the footwear article.

4. The article of claim 2 wherein the placard, the lateral portion of the upper, and the retaining member individually include a top edge and a plurality of holes which are adjacent to the respective top edge, and wherein the holes of the placard, the lateral portion of the upper, and the retaining member are aligned with one another and configured to receive at least one fixing member when the placard is received within the pocket.

5. The article of claim 2 wherein a top portion of the retaining member which is adjacent to a heel region of the footwear article is attached to the lateral portion of the upper to form a heel pocket which opens towards a toe region of the footwear article to receive a portion of the placard.

6. The article of claim 1 further comprising the placard which extends from a first location of the footwear article which is adjacent to a toe region of the footwear article to a second location which is adjacent to a heel region of the footwear article.

7. The article of claim 1 wherein the placard comprises a first interchangeable placard, and wherein the medial portion of the upper is configured to retain a second interchangeable placard in a position with respect to the footwear article wherein the second placard covers substantially an entirety of the medial portion of the upper of the footwear article, and wherein the first and second placards substantially change the outwards appearance of the footwear article when the first and second placards are retained adjacent to the lateral and medial portions of the upper, respectively.

8. The article of claim 1 further comprising a heel cover which is configured to attach to the footwear article adjacent to a heel region of the footwear article.

9. A footwear article comprising:

an insole configured to support a foot of the individual when the footwear article is worn by the individual;

an outsole which contacts the ground when the footwear article is worn by the individual;

an upper configured to hold the footwear article to the foot of the individual when the footwear article is worn by the individual, wherein the upper includes a lateral portion and a medial portion;

a retaining member which is adjacent to the lateral portion of the upper and which extends from a first location of the footwear article which is adjacent to a toe region of the footwear article to a second location which is adjacent to a heel region of the footwear article, wherein the retaining member defines a pocket with the lateral portion of the upper which is configured to receive an interchangeable placard; and wherein the placard, the lateral portion of the upper, and the retaining member individually include a top edge and a plurality of holes which are adjacent to the respective top edge, and wherein the holes of the placard, the lateral portion of the upper, and the retaining member are aligned with one another and configured to receive at least one fixing member when the placard is received within the pocket.

10. The article of claim 9 wherein the retaining member and the placard individually extend from a heel region to a toe region of the footwear article.

11. The article of claim 9 wherein the lateral and medial portions of the upper individually comprise a retaining region which is changeable between an open configuration to permit ingress and egress of the foot of the individual into and out of the footwear article and a closed configuration wherein the upper holds the footwear article to the foot of the individual, and wherein the placard extends past the attachment region in a forward direction toward a toe region of the footwear article and a rearward direction toward a heel region of the footwear article.

12. The article of claim 9 further comprising the placard which extends from a first location of the footwear article which is adjacent to a toe region of the footwear article to a second location which is adjacent to a heel region of the footwear article.

13. A footwear article comprising:

an insole configured to support a foot of an individual when the footwear article is worn by the individual;

an outsole which contacts the ground when the footwear article is worn by the individual;

an upper configured to hold the footwear article to the foot of the individual when the footwear article is worn by the individual, wherein the upper includes a lateral portion and a medial portion;

wherein the lateral portion of the upper is configured to retain an interchangeable placard in a position with respect to the footwear article wherein the placard covers substantially an entirety of the lateral portion of the upper of the footwear article; and wherein the placard, the lateral portion of the upper, and the retaining member individually include a top edge and a plurality of holes which are adjacent to the respective top edge, and wherein the holes of the placard, the lateral portion of the upper, and the retaining member are aligned with one another and configured to receive at least one fixing member when the placard is received within the pocket.

14. A footwear article comprising:

an insole configured to support a foot of an individual when the footwear article is worn by the individual;

an outsole which contacts the ground when the footwear article is worn by the individual;

an upper configured to hold the footwear article to the foot of the individual when the footwear article is worn by the individual, wherein the upper includes a lateral portion and a medial portion;

wherein the lateral portion of the upper is configured to retain an interchangeable placard in a position with respect to the footwear article wherein the placard covers substantially an entirety of the lateral portion of the upper of the footwear article; and wherein a top portion of the retaining member which is adjacent to a heel region of the footwear article is attached to the lateral portion of the upper to form a heel pocket which opens towards a toe region of the footwear article to receive a portion of the placard.

15. A footwear article comprising:

an insole configured to support a foot of the individual when the footwear article is worn by the individual;

an outsole which contacts the ground when the footwear article is worn by the individual;

an upper configured to hold the footwear article to the foot of the individual when the footwear article is worn by the individual, wherein the upper includes a lateral portion and a medial portion;

a retaining member which is adjacent to the lateral portion of the upper and which extends from a first location of the footwear article which is adjacent to a toe region of the footwear article to a second location which is adjacent to a heel region of the footwear article, wherein the retaining member defines a pocket with the lateral portion of the upper which is configured to receive an interchangeable placard; and wherein the lateral and medial portions of the upper individually comprise a retaining region which is changeable between an open configuration to permit ingress and egress of the foot of the individual into and out of the footwear article and a closed configuration wherein the upper holds the footwear article to the foot of the individual, and wherein the placard extends past the attachment region in a forward direction toward a toe region of the footwear article and a rearward direction toward a heel region of the footwear article.

* * * * *